US011220364B2

(12) United States Patent
Harth et al.

(10) Patent No.: US 11,220,364 B2
(45) Date of Patent: Jan. 11, 2022

(54) DEVICE AND METHOD FOR FEEDING FILM BAGS TO A FILLING MACHINE

(71) Applicant: INDAG Pouch Partners GmbH, Eppelheim (DE)

(72) Inventors: Rolf Harth, Neckargemünd (DE); Frank Lechert, Weinheim (DE)

(73) Assignee: INDAG POUCH PARTNERS GMBH, Eppelheim (DE)

( * ) Notice: Subject to any disclaimer, the term of this patent is extended or adjusted under 35 U.S.C. 154(b) by 552 days.

(21) Appl. No.: 15/750,741

(22) PCT Filed: Aug. 5, 2016

(86) PCT No.: PCT/EP2016/068787
§ 371 (c)(1),
(2) Date: Feb. 6, 2018

(87) PCT Pub. No.: WO2017/025474
PCT Pub. Date: Feb. 16, 2017

(65) Prior Publication Data

US 2019/0352031 A1 Nov. 21, 2019

(30) Foreign Application Priority Data

Aug. 7, 2015 (EP) ..... 15180156

(51) Int. Cl.
*B65B 43/18* (2006.01)

(52) U.S. Cl.
CPC ..... *B65B 43/18* (2013.01)

(58) Field of Classification Search
CPC ..... B65B 43/18
See application file for complete search history.

(56) References Cited

U.S. PATENT DOCUMENTS 2,288,603 A * 7/1942 Berch ..... B65B 43/34 53/384.1
3,323,280 A * 6/1967 Rausch ..... B65B 43/26 53/571

(Continued)

FOREIGN PATENT DOCUMENTS

DE 4035815 A1 5/1992
GB 694699 A 7/1953

(Continued)

OTHER PUBLICATIONS

English translation of the Notice of Reasons of Rejection received in Japanese Patent Application No. 2018-506327 and dated Feb. 19, 2019 (3 pages).

(Continued)

*Primary Examiner* — Anna K Kinsaul
*Assistant Examiner* — Daniel Jeremy Leeds
(74) *Attorney, Agent, or Firm* — Mayer Brown LLP

(57) ABSTRACT

The invention relates to a device for feeding film bags to a filling machine, comprising a magazine having a plurality of parallel magazine shafts for providing the film bags and comprising film-bag holders, which can be positioned below the magazine shafts, for holding and transporting the film bags, wherein a transfer arm is associated with each magazine shaft, said transfer arm being provided for grasping a film bag in the magazine shaft and transferring the grasped film bag to the film-bag holder arranged below the magazine shaft. The invention further relates to a method for feeding film bags to a filling machine by means of the device, comprising the following steps: providing film bags in magazine shafts of a magazine, positioning film-bag holders for holding and transporting the film bags below the magazine shafts, grasping the film bags in the magazine shafts by (Continued)

means of transfer arms, and transferring the grasped film bags to the film-bag holders by means of the transfer arms.

20 Claims, 10 Drawing Sheets

(56) References Cited

U.S. PATENT DOCUMENTS 3,511,395 A * 5/1970 Brown, Jr. ..... B65B 41/06 414/801
3,955,334 A * 5/1976 Wild ..... B65B 43/18 53/459
4,108,300 A * 8/1978 Hayase ..... B65B 43/26 198/470.1
4,473,989 A * 10/1984 Tsutsumi ..... B65B 43/30 141/166
5,180,356 A * 1/1993 Wakabayashi ..... B65B 41/06 493/316
5,463,845 A * 11/1995 Gwiazdon ..... B65B 43/52 53/250
5,480,372 A * 1/1996 Gwiazdon ..... B65B 43/52 271/102
6,880,310 B2 * 4/2005 Main ..... B65B 43/18 53/386.1
10,144,545 B2 * 12/2018 Bianchi ..... B65B 43/14
2008/0110132 A1 * 5/2008 Ruz ..... B65B 43/18 53/459
2009/0274538 A1 11/2009 Kurz et al.
2014/0331603 A1 * 11/2014 Takahashi ..... B65B 31/06 53/408
2014/0334909 A1 * 11/2014 Ishikawa ..... B65B 43/46 414/795.4
2015/0307219 A1 * 10/2015 Kariyada ..... B65H 5/10 414/783
2019/0161265 A1 * 5/2019 Pentzer ..... B65B 43/18

FOREIGN PATENT DOCUMENTS

JP S57-204802 A 12/1982
JP 2009-280282 A 12/2009
WO 2014/121430 A1 8/2014

OTHER PUBLICATIONS

Communication Pursuant to Article 94(3) EPC dated Dec. 6, 2017 issued in European Patent Application No. 15180156.0.
European Search Report dated Jan. 28, 2016 in European Patent Application No. 15180156.0.
English translation of the communication received from the European Patent Office in EP 15180156.0 and dated Dec. 6, 2017.
English translation of the European Search Report of EP 15180156.0 and dated Nov. 27, 2015.

* cited by examiner

DEVICE AND METHOD FOR FEEDING FILM BAGS TO A FILLING MACHINE

CROSS-REFERENCE TO RELATED APPLICATIONS

This application is a U.S. national stage entry of International Application No. PCT/EP2016/068787, filed Aug. 5, 2016, which claims priority to European Application No. 15180156.0, filed Aug. 7, 2015, the contents of both of which are incorporated by reference herein in their entirety.

BACKGROUND OF THE INVENTION

1. Field of the Invention

The invention relates to an apparatus for feeding film bags to a filling machine and relates to a corresponding method.

2. Description of Related Art

It is known to drop film bags provided in the magazine shafts of a magazine into the magazine shafts so that they are dragged downwardly by gravitation. In this manner, the film bags arrive in film bag holders positioned below the magazine shafts for receiving and transporting the film bags. By using gravitation for the downward movement of the film bags, an appropriate alignment of the film bag with respect to the film bag holder cannot always be guaranteed, since film bags may rotate or twist within a magazine shaft. Moreover, the machine speed is limited.

SUMMARY OF THE INVENTION

It is the object of the present invention to provide an apparatus and a method for feeding film bags to a filling machine, which enables a precise transfer of film bags provided in magazine shafts to film bag holders even at high machine speed.

The object is solved by the apparatus and the method described herein. Preferred embodiments and variants are also disclosed.

The apparatus for feeding film bags to a filling machine comprises a magazine including a plurality of magazine shafts arranged in parallel for providing the film bags for holding and transporting the received film bags, which are positionable below the magazine shafts. Moreover, a transfer arm for grasping a film bag in the magazine shaft and for transferring the grasped film bag is associated with the film bag holder positioned below the magazine shaft.

Due to the usage of the transfer arm, a specific transfer of the film bags to the film bag holders is accomplished, thereby allowing avoidance of a rotation or twist of the film bags in the magazine shafts. In this manner, the apparatus may even be operated at high machine speeds, wherein a specific transfer of the film bags to the film bag holders is always accomplished. The grasping and transferring of the film bags by means of the transfer arms may be considered as a restricted guidance, since accidental, non-intended movements of the film bags are avoided.

Each of the transfer arms may comprise at least one suction device for sucking the film bags. The suction devices provide for a gentle grasping of the film bags and for safe transport from the magazine shafts to the film bag holders. The suction devices may be provided with one or more devices for generating negative pressure. For example a transfer arm comprises two suction devices having a circle-shaped or at least substantially circle-shaped cross section, wherein the suction devices attach symmetrically to a film bag.

Each of the suction devices may be adapted to at least partially two-dimensionally suck the film bags. For grasping and transferring the film bags to the film bag holders, it is sufficient to not completely suck the film bags by the suction devices, but rather, to suck a partial area of the respective film bag. Due to the partially two-dimensional suction, a subsequent removal of the suction device from the film bag is also simplified.

The transfer arms may be configured to be rotatable around a common horizontal axis and may be vertically movable by means of a common support. The rotatability of the transfer arms allows the grasping of the film bags in the magazine shafts, bringing them into an orientation, by which they may be at least partially removed from the magazine shaft by vertical displacement of the support and by which they may be at least partially introduced into the film bag holders. As a drive for the support for vertical movement, i.e., movement upwardly and downwardly, a rack including drive gears may be provided in the upper area of the support.

A spool device or slider device may be positioned between two neighboring magazine shafts, which comprises at least one spool or at least one slider that is preferably vertically displaceable. By means of the spool, film bags within the film bag holders may be held in position in a certain manner without causing unwanted movement in the upward direction, for example, when releasing and subsequently moving a transfer arm with respect to the film bag.

The spool device may be positioned between two neighboring magazine shafts such that the first one of the two spools may act on film bags of one of the magazine shafts while the other one of the two spools may act on each of the film bags of the other magazine shaft. Generally, acting of the spools on a film bag is, therefore, accomplished in the upper right or left periphery of the film bag.

Between the at least one spool and a base body of the magazine, a transfer gap may be formed. The transfer gap is formed when the at least one spool is moved downwardly, thereby supporting the specified transfer of the film bag to the film bag holder, since any unwanted movement of the film bag is avoided. The width of the transfer gap, preferably less than 1 mm, may, however, be adapted to the width of the type of the film bag.

The at least one spool may comprise a labyrinth guide for suppressing an upward movement of the film bag. The labyrinth guide is provided for suppressing an upward movement of a film bag, for example, when a transfer arm is moved after being released from the film bag. For example, the labyrinth guide may be formed as a protrusion. Since the labyrinth guide is positioned at least partly in the transport path of the film bag grasped and moved by the transfer arm, the film bag, upon being moved downwardly, is bent at its right and left edge regions due to contact with the labyrinth guide.

The spool device may comprise a housing that receives the at least one spool.

The apparatus may further comprise at least one counter-holder configured to be horizontally movable for suppressing an upward movement of the film bag. While a film bag is grasped and at least partially introduced into a film bag holder by a transfer arm, the at least one counter-holder is preferably positioned in a first position outside the trajectory of the transfer arm and/or the film bag. After introducing the film bag at least partially into the film bag holder, the at least one counter-holder may be moved horizontally from the first position to a second position such that the at least one counter-holder is positioned above the film bag such that any unwanted upward movement of the film bag may be suppressed, for instance, when a transfer arm is decoupled from a film bag or is subsequently moved upwardly.

The film bag holders may be configured as bracket/lock casings.

The method of feeding film bags to a filling machine by using an apparatus as described above or as described further below comprises the steps: providing film bags in magazine shafts of a magazine, positioning film bag holders for receiving and transporting the film bags below the magazine shafts, thereafter grasping the film bags in the magazine shafts by means of transfer arms and transferring the grasped film bags to the film bag holders by means of the transfer arms.

In each of the magazine shafts a certain number of film bags may be provided and prior to using this number of film bags, further film bags may be refilled. Since the film bags are to be transported from the magazine to a filling machine, film bag holders are provided below the magazine. In this manner, for a number n of magazine shafts positioned in parallel, there are provided n film bag holders, wherein one film bag holder is positioned below one magazine shaft. In this manner, a film bag of a magazine shaft may be transferred to a film bag holder and subsequently transported there through. By grasping a film bag in a magazine shaft, a guided movement of the bag may be accomplished in order to enable the transfer of it to the film bag holder in a defined manner.

The step of grasping may include sucking the film bag by means of suction devices, wherein a film bag is, for instance, at least partially two-dimensionally sucked. By means of the partially two-dimensional suction, a subsequent detachment or decoupling of the suction device from the film bag is simplified. The suction devices may enable a gentle grasping of the film bags and save transport from the magazine shafts to the film bag holders. The suction may be accomplished by generating negative pressure.

The step of transferring may further comprise the following step: rotating the transfer arm around a common horizontal axis and thereby positioning the film bag in an at least substantially vertical orientation. On the basis of this orientation, the film bags may be transferred to the film bag holders. By rotating around the horizontal axis, the transfer arms may be moved such that they at least partially remove the film bags from the magazine shaft starting from the position of grasping in a magazine shaft.

After the step of grasping and prior to the step of rotating, the spools may be extended or extracted. The extended or extracted spools may subsequently provide for eliminating any unwanted upward movements of film bags introduced into the film bag holders upon releasing or decoupling the transfer arms from the film bags and upon moving the released transfer arms upwardly.

After the rotation, the further steps may follow: moving the transfer arms downwardly and introducing at least partially the film bags into the film bag holders, and after their introduction, releasing or decoupling the suction devices from the film bags. During the downward movement of the transfer arms, the film bags also pass the extended spools and their labyrinth guide. In this case, each of the film bags contacts the labyrinth guide so that a film bag is bent at its right and left edge areas. When a film bag is received in a film bag holder, in the case of a bracket/lock casing, for example, abutting at its case bottom, the spools and the labyrinth guides prevent the film bag from moving upwardly. Therefore, the suction device may be decoupled from the film bag and the suction arm may be moved upwardly.

After the step of releasing or decoupling, the transfer arms may be moved upwardly. Preferably, the transfer arms are also rotated such that the transfer arms are positioned to again allow the grasping of film bags.

After the upward movement of the transfer arms, the spools may be moved upwardly. After the upward movement of the spools, the film bag holders may be moved out of their positions below the magazine shafts. The film bag holders may then feed the film bags to a filling machine.

BRIEF DESCRIPTION OF THE DRAWINGS

For a better understanding and for illustration, the attached figures illustrate some aspects of the invention as examples. In the figures.

DETAILED DESCRIPTION OF THE INVENTION

The sequence of FIGS. 1 to 6 schematically illustrates how a film bag of a magazine is transferred to a bracket/lock casing via a transfer arm.

Figure 1:
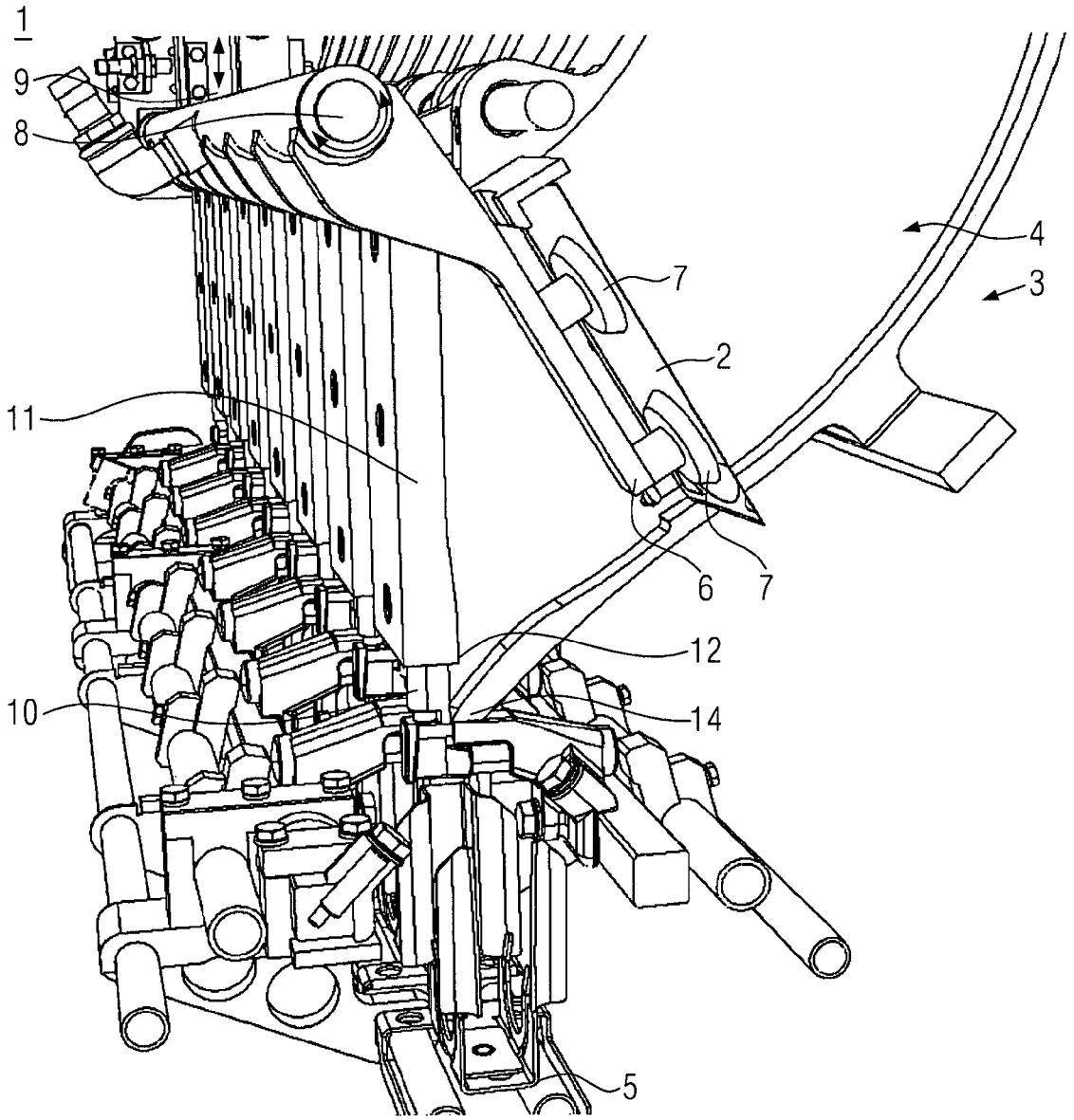
FIG. 1 is a first schematic view of an apparatus for feeding film bags to a filling machine by grasping film bags in the magazine shafts by transfer arms.

FIG. 1 illustrates a first schematic view of an apparatus 1 for feeding film bags 2 to a filling machine (not illustrated), which comprises a magazine 3 having a plurality of magazine shafts 4 positioned in parallel for providing the film bag 2 and with film bag holders 5 that are positionable below the magazine shafts 4 in order to receive and transport the film bags 2. The number of film bag holders 5 preferably corresponds to the number of magazine shafts 4. Moreover, each magazine shaft 4 is associated with or assigned to a transfer arm 6 for grasping the film bags 2 in the magazine shaft 4 and for transferring the grasped film bag 2 to the film bag holders 5 positioned below the magazine shaft 4.

In the illustration, each of the transfer arms 6 includes two suction devices 7 for sucking a film bag 2 and, thus, for holding the film bag 2, by means of which the film bag 2 is at least partially two-dimensionally sucked. The plural transfer arms 6 are rotatable around a common horizontal axis 8 and are configured to be vertically movable by means of a common support 9 such that the transfer arms 6 are synchronously moved in any of the magazine shafts 4.

In FIG. 1, the visible transfer arm 6 as well as the other non-visible transfer arms are in a tilted position, that is, they are rotated around the horizontal axis 8 by a certain angle value, thereby enabling sucking and, thus, holding or grasping one of the film bags 2 provided in the magazine shaft 4 by means of the suction devices 7. In the embodiment illustrated, the holding or grasping of the film bag 2 is accomplished, for instance, by generating negative pressure.

Moreover, the apparatus 1 is provided with spool or slider devices, wherein each spool device comprises a housing 11 and two spools or sliders 10. The spools 10 are configured to be movable upwardly and downwardly in the vertical direction. A spool device is positioned between two neighboring magazine shafts 4 such that the first of the two spools 10 is able to act on one film bag 2 of the one magazine shaft 4 and the second one of the spools 10 is able to act on the other film bag 2 of the other neighboring magazine shaft. Generally, a film bag 2 is acted upon by the spool 10 at the right and left upper edge areas of the film bag 2.

This arrangement of the spool device between neighboring magazine shafts 4 provides for free movability of the transfer arms 6 upon rotating around the common horizontal axis 8.

The two outer magazine shafts 4 of the magazine 3, each having only a single neighboring magazine shaft 4, preferably comprise a differently formed spool device with a housing and only one spool at the side without a neighboring magazine shaft.

The spools 10 are moved out downwardly from the housing 11 after a transfer arm 6 has grasped a film bag 2 and prior to positioning the film bag 2 in a vertical or substantially vertical orientation by the transfer arm 6. Between the extended spool 10 and the base body of the magazine 3 a transfer gap 13 is, therefore, formed, that preferably has a width of approximately 1 mm or less.

The spools 10 additionally comprise a labyrinth guide 12, which, in the present case, is formed as a protrusion. The labyrinth guide 12 prevents the film bag 2 from moving upwardly when being guided to the box bottom of a bracket/lock casing, for instance, when the transfer arm 6 detaches from the film bag 2 or is subsequently moved upwardly.

Since the labyrinth guide 12 is positioned, at least partly, in the transport path of the film bag 2, grasped and moved by the transfer arm 6 with the spool 10 moved downwardly, the film bag 2 is correspondingly bent at its right and left edge areas upon being moved downwardly. This, however, does not interfere with the operation of the apparatus 1, since the material of the film bag 2 exhibits a certain flexibility and returns to its original shape after having passed the labyrinth guide.

Figure 2:
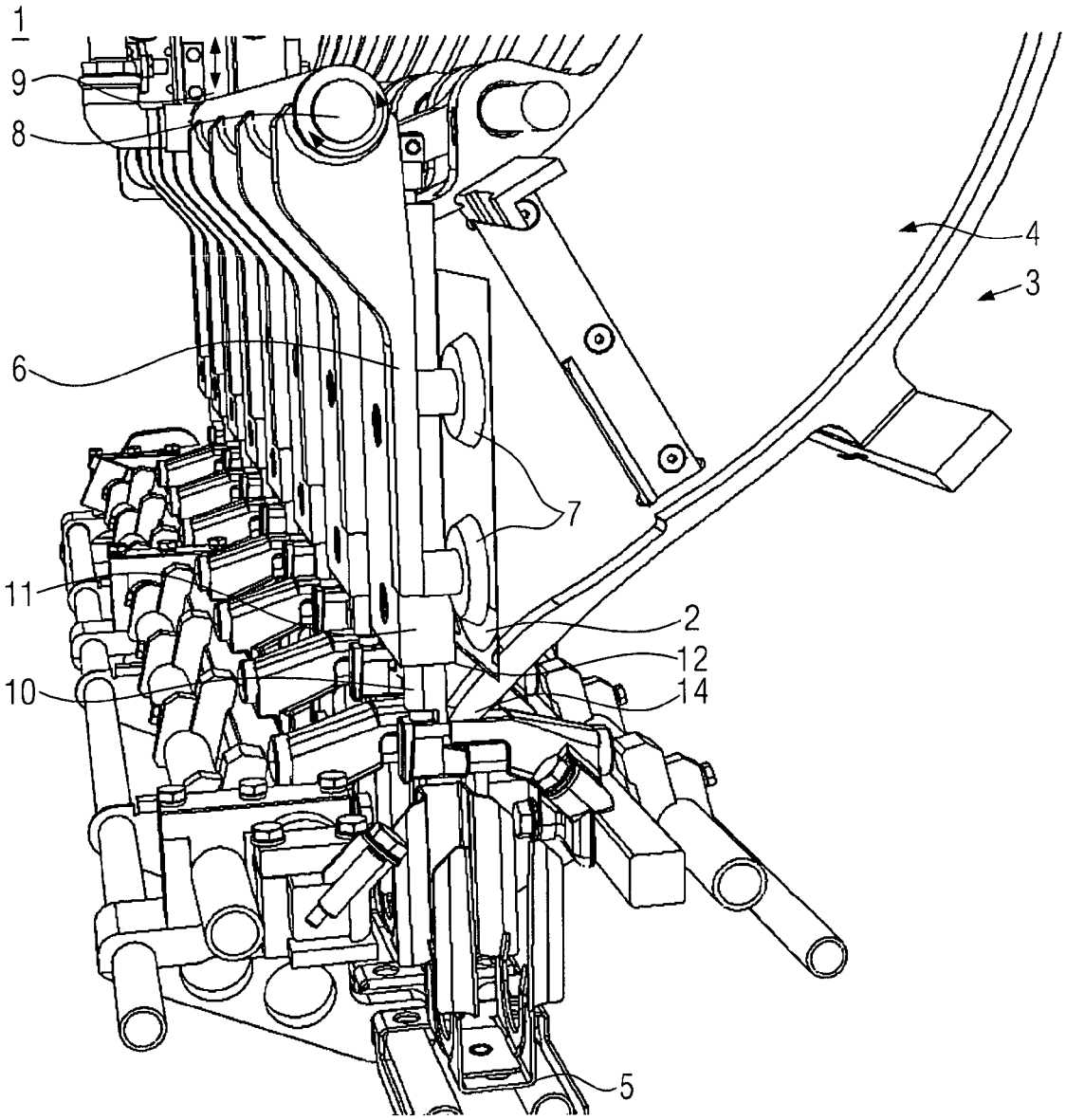
FIG. 2 is a second schematic view of the apparatus after the film bags together with the transfer arms have been moved in a vertical orientation.

FIG. 2 illustrates a second schematic view of the apparatus 1, in which the visible transfer arm 6, as well as the other non-visible transfer arms, are rotated around the horizontal axis 8, i.e., by the certain angle value, such that the film bag 2 grasped by the transfer arm 6 is vertically or substantially vertically oriented. In this orientation, the transfer arm 6 may be moved downwardly by means of the common support 9, i.e., they may be moved to the film bag holders 5 positioned below the magazine shaft 4, such that the film bags 2 can be inserted, at least partially, into the film bag holders 5, for instance, the bracket/lock casing 5.

Figure 3:
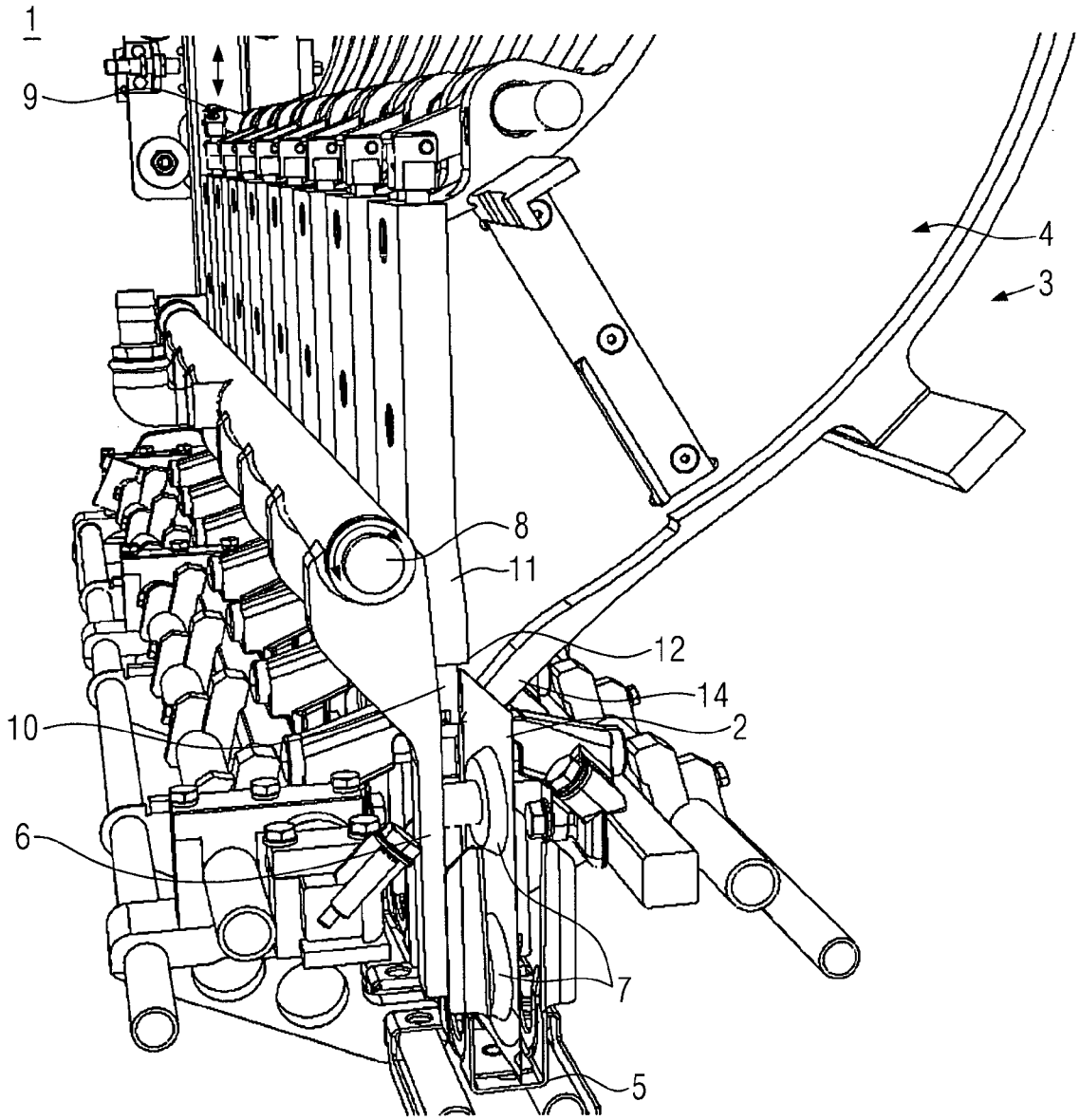
FIG. 3 is a third schematic view of the apparatus with downwardly moved transfer arms and film bags standing on the case bottom.

FIG. 3 illustrates a third schematic view of the apparatus 1, in which the film bag 2 has been partly inserted into the bracket/lock casing 5 positioned below the magazine shaft 4 by vertically moving the transfer arm 6 downwardly. The transfer arm 6 is moved downwardly to a degree such that the film bag 2 reaches the casing bottom of the bracket/lock casing 5. In this view, the film bag 2 is still attached to the transfer arm 6 by the suction devices 7. The upper portion of the film bag 2 may protrude into the magazine shaft 4. The right and left upper edge areas of the film bag 2 are positioned adjacent to the extended spools 10 that are associated with this magazine shaft 4.

Figure 4:
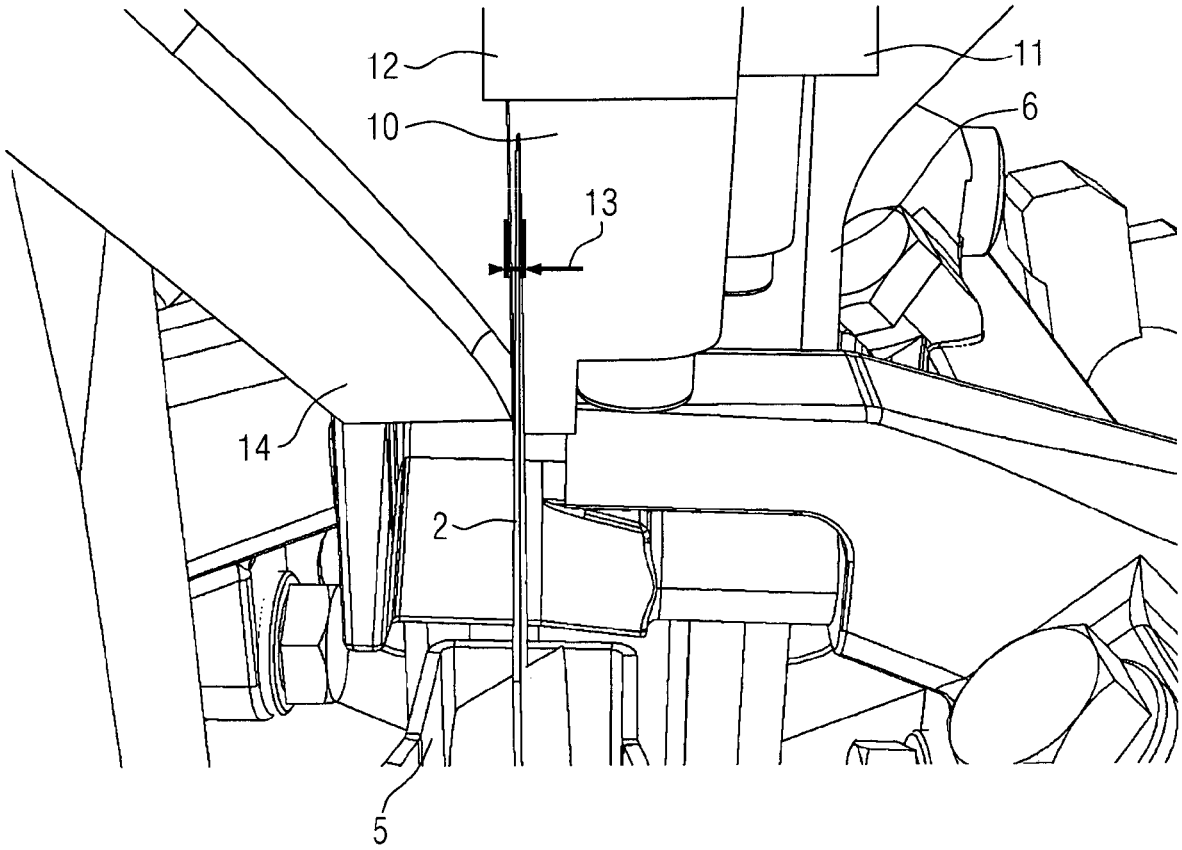
FIG. 4 is a first enlarged schematic view of the apparatus including the labyrinth guide and extended spools.

FIG. 4 illustrates a first enlarged schematic view of the apparatus 1; compared to FIGS. 1 to 3 the right hand side and the left hand side are now interchanged. The film bag 2 has been partially inserted into the bracket/lock casing 5 positioned below the magazine shaft 4 by means of the transfer arm 6 so as to stand uprightly on the casing bottom. The spool 10 having the labyrinth guide 12 serves the purpose of forming a transfer gap 13 between the spool 10 and the base body 14 of the magazine 3. The film bag 2 protrudes with its upper portion into the magazine shaft 2. The labyrinth guide 12 of the spool 10, in this case provided in the form of a protrusion, eliminates an upward movement of the film bag 2, for instance, when the transfer arm 6 is decoupled from the film bag 2 or is subsequently moved upwardly.

Figure 5:
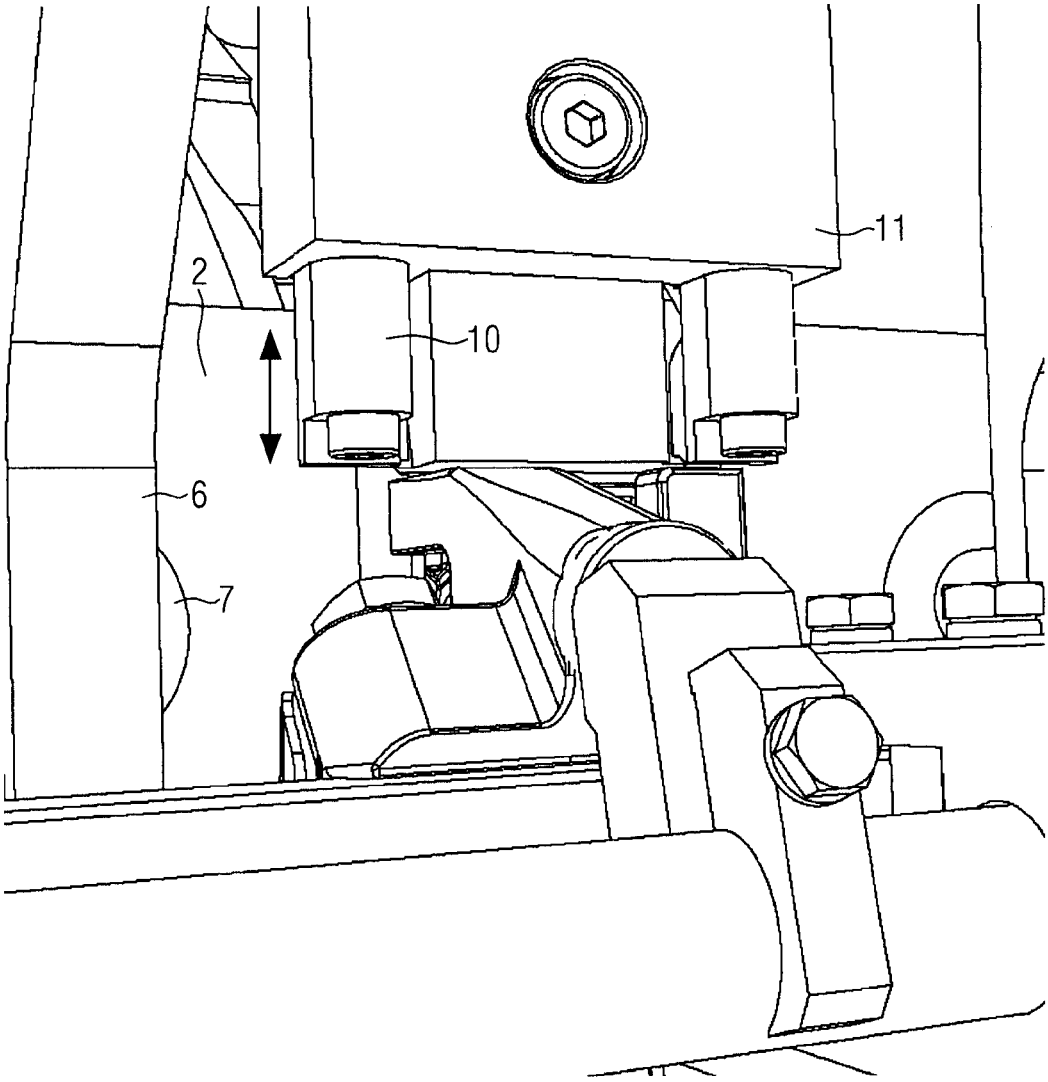
FIG. 5 is a second enlarged schematic view of the apparatus with extended spools.

FIG. 5 shows a second enlarged schematic view of the apparatus 1, in which the two spools 10 of the spool device shown are extended. As already discussed, a spool device is positioned between respective two neighboring magazine shafts 4 such that the first one of the two spools acts on each of the film bags 2 of one of the magazine shafts 4 and the second one of the two spools acts on each one of the film bags 2 of the other magazine shaft. In the illustration, one of the film bags 2 is being acted upon by the two spools 10 at the edge area at the right hand side, and the other film bag 2 is acted upon at the upper edge area at the left hand side. Only shortly before the bracket/lock casing 5 is moved away from its position below the magazine shaft 4 is the spool 10 moved upwardly (after detaching the transfer arm 6 from the film bag 2).

Figure 6:
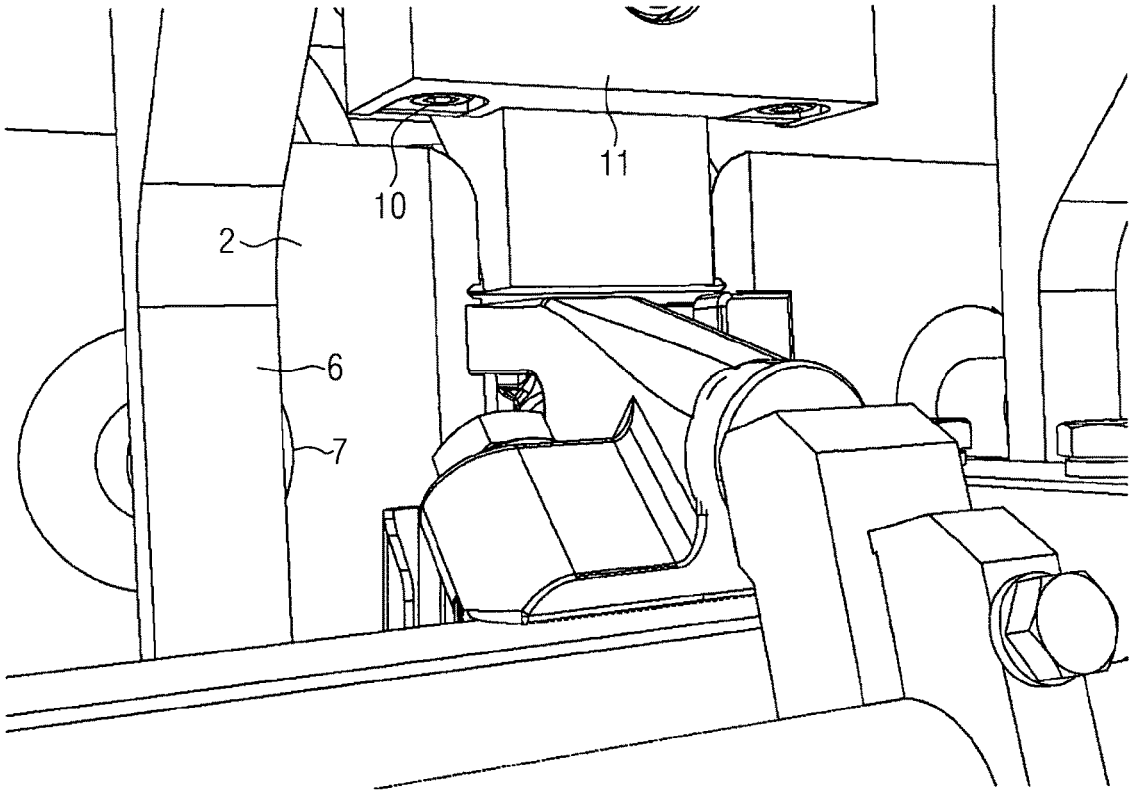
FIG. 6 is a third enlarged schematic view of the apparatus with retracted spools.

In FIG. 6 there is shown a third enlarged schematic view of the apparatus 1, in which the spools 10 are retracted, that is, moved upwardly and are received by the housing 11 of the spool device. After retracting the spools 10, the film bag holders 5, together with the film bags 2 provided therein, may be removed from their position below the magazine shafts 4.

Figure 7:
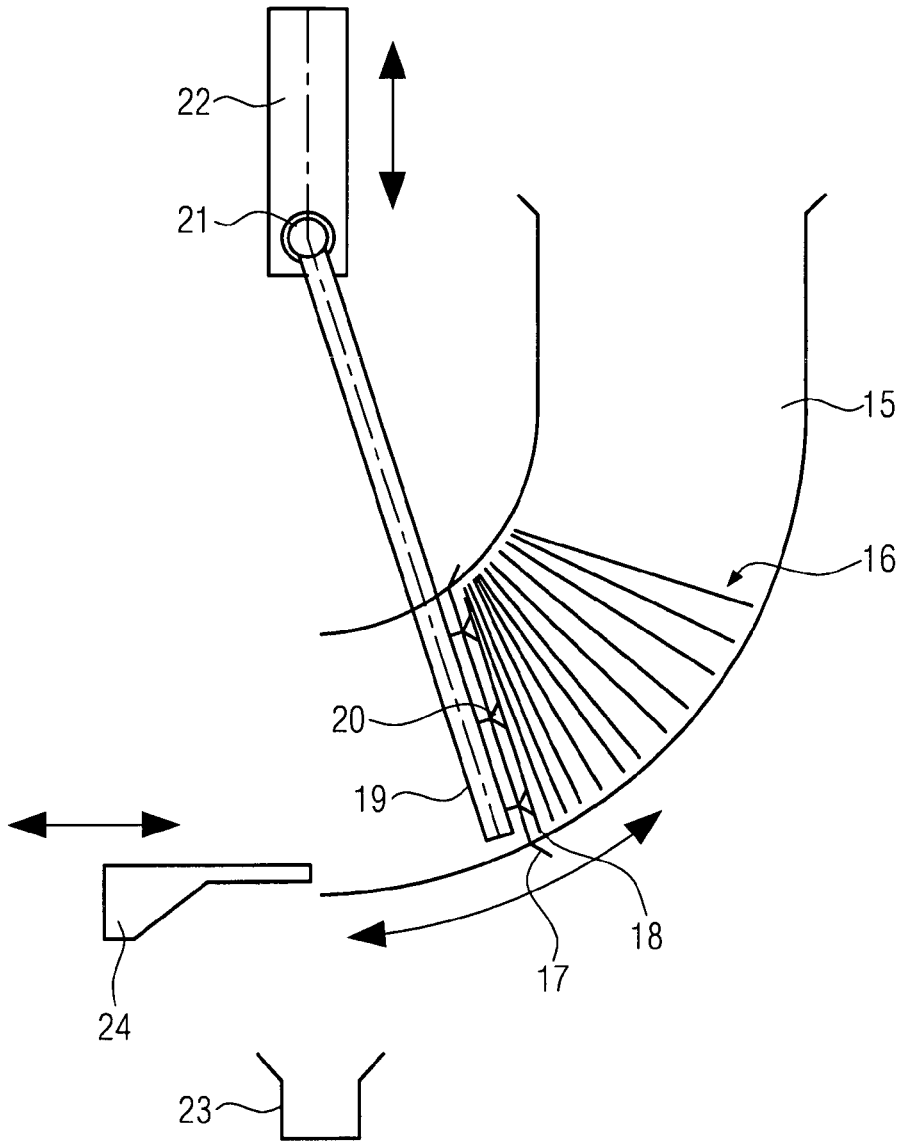
FIG. 7 is a first simplified view of a lateral counter-holder and a magazine shaft in cross-sectional view upon grasping a film bag in the magazine shaft by a transfer arm having three suction devices.

FIG. 7 shows a first simplified view of a lateral counterholder 24 and of a magazine shaft 15 in cross section upon grasping a film bag 18 in the magazine shaft 15 by a transfer arm 19 having three suction devices 20. In the magazine shaft 15, a plurality of film bags 16, 18 is provided, that are positioned in the magazine shaft 15 by a holder 17. The three suction devices 20 serve the purpose to suck the film bags 18 and, thus, to hold the film bags 18, wherein the suction devices 20 at least partially suck the film bags 18 in a two-dimensional manner, for example, by generating negative pressure. A film bag holder 23 is positioned below the magazine shaft 15 in order to receive and transport a film bag 16, 18.

The transfer arm 19 illustrated is configured to be rotatable around a horizontal axis 21 and is configured to be vertically movable by means of a support 22. Moreover, the apparatus comprises at least one counter-holder 24 configured to be horizontally movable.

In FIG. 7, the transfer arm 19 is in a tilted position, that is, it is rotated around the horizontal axis 21 by a certain angle value so as to be able to suck and, thus, hold or grasp a film bag 18 provided in the magazine shaft 15 by means of the suction devices 20.

Figure 8:
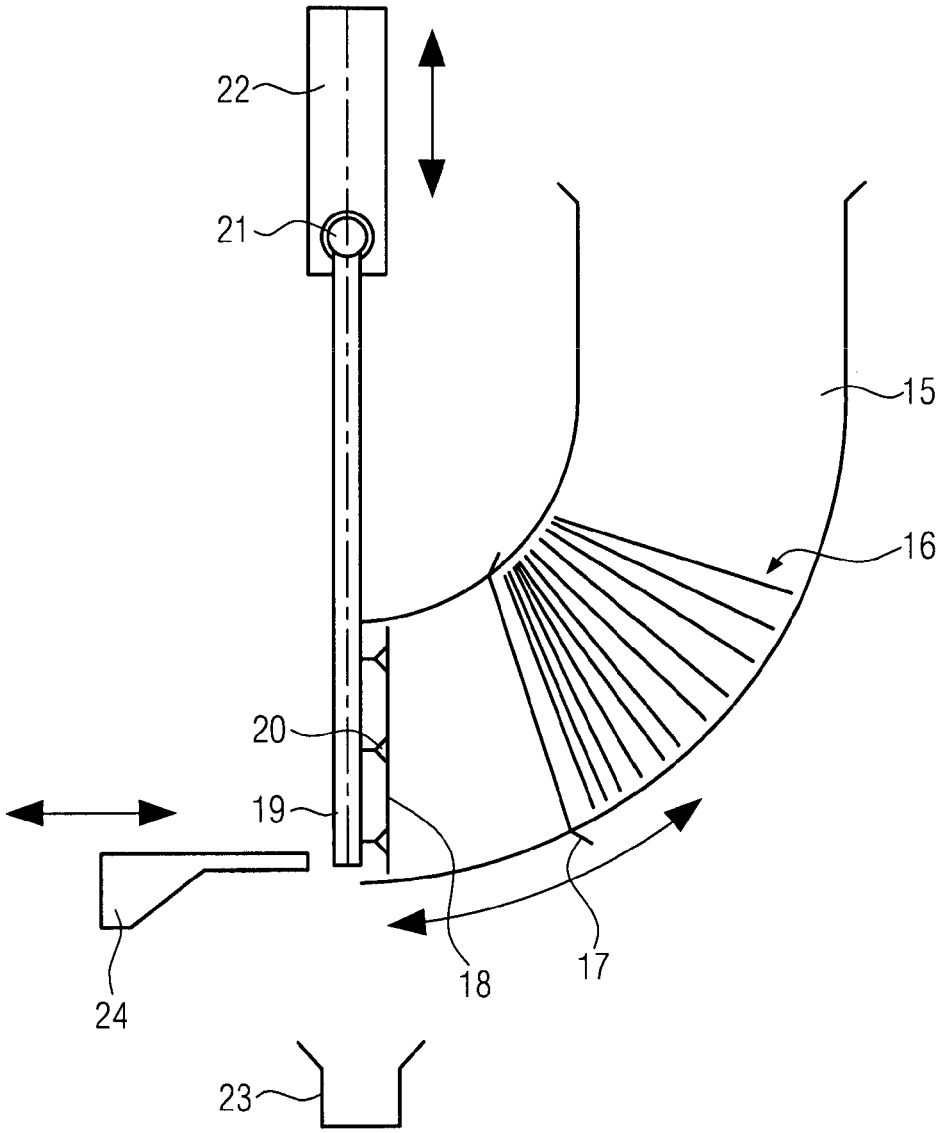
FIG. 8 is a second simplified view of the lateral counter-holder and the magazine shaft in cross section after having moved the film bag together with the transfer arm into a vertical orientation.

FIG. 8 illustrates a second simplified view of the lateral counter-holder 24 and the magazine shaft 15 in cross section after having moved the film bag 18 into an at least substantially vertical orientation by means of the transfer arm 19.

From the position as shown in FIG. 7, the transfer arm 19 was rotated around the horizontal axis 21, i.e., it was rotated by a certain angle value, such that the film bag 18 grasped by the transfer arm 19 is at least approximately oriented vertically. In this orientation, the transfer arm 19 may be moved downwardly by means of the support 22, that is, it may be moved to the film bag holder 23 positioned below the magazine shaft 15 such that the film bag 18 may be inserted, at least partially into the film bag holder 23, for instance, a bracket/lock casing. The counter-holder 24 was horizontally displaced such that the transfer arm 19 upon being moved downwardly does not contact the counter-holder 24.

Figure 9:
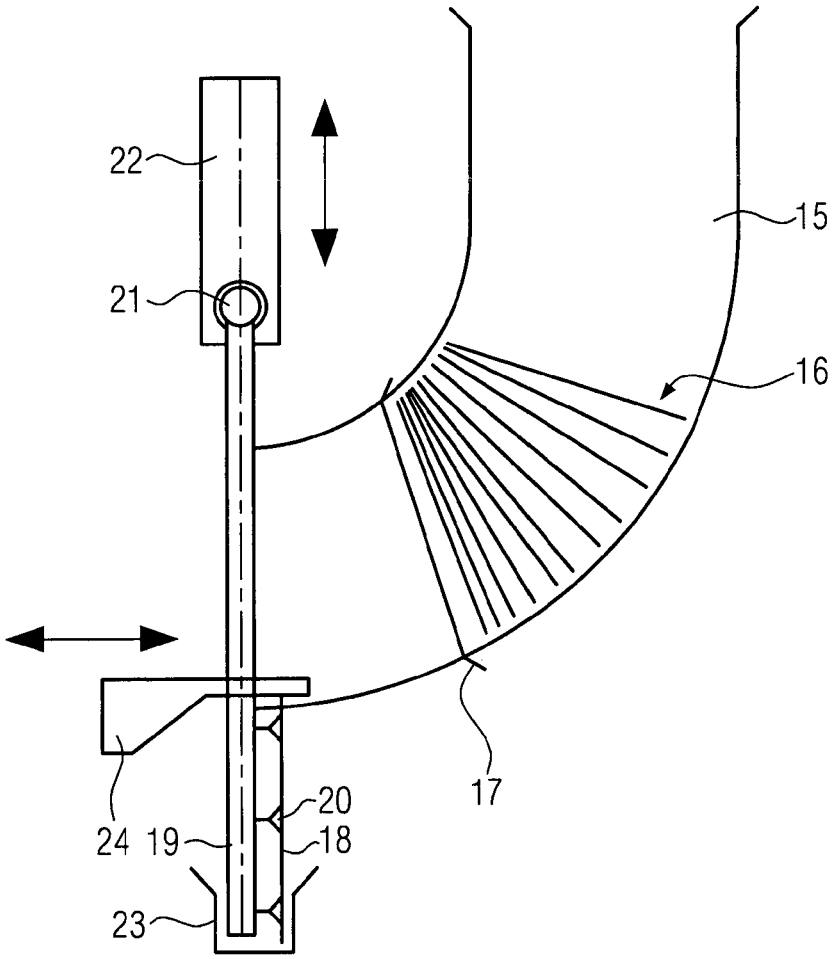
FIG. 9 is a third simplified view of the horizontally moved counter-holder, the magazine shaft with a downwardly moved transfer arm and a film bag standing upright on the box bottom.

FIG. 9 illustrates a third simplified view of the horizontally moved counter-holder 24 and the magazine shaft 15 including the transfer arm 19 moved downwardly and the film bag 18 standing on the casing bottom of the bracket/lock casing 23. After having moved the transfer arm 19 together with the film bag 18 in the downward direction, the counter-holder 24 is moved horizontally into a position above the film bag 18 such that the counter-holder 24 may prevent the film bag from unintentionally moving upwardly upon detaching the transfer arm 19 from the film bag 18 and upon moving the transfer arm 19 upwardly.

Figure 10:
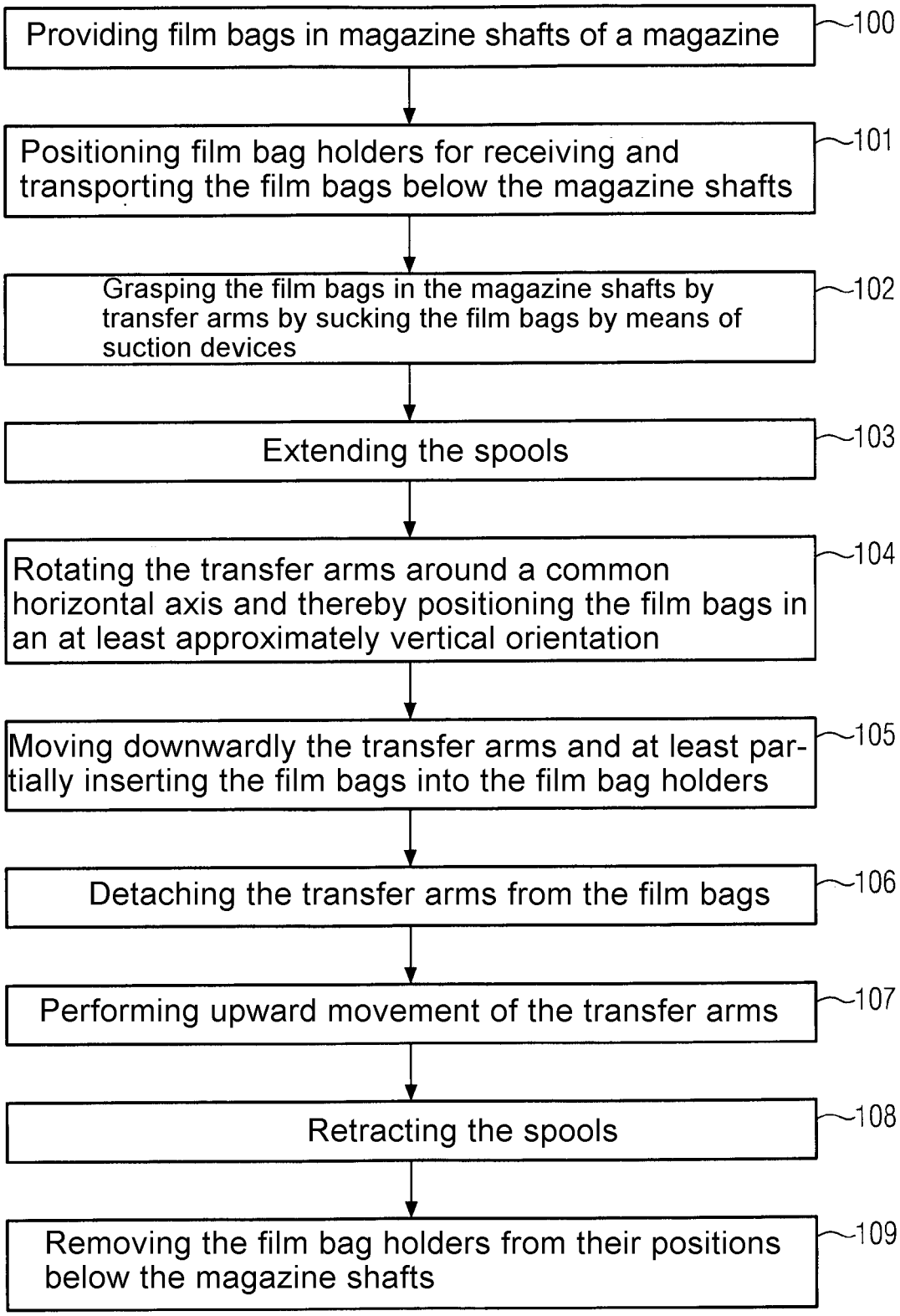
FIG. 10 is a flow chart of a method for feeding film bags to a filling machine.

FIG. 10 illustrates a flow chart of a method for feeding film bags to a filling machine by using an apparatus for feeding film bags, as described above or below.

In step 100, film bags are provided in the magazine shafts of a magazine, wherein several magazine shafts are arranged in parallel. The film bag holders for receiving and transporting the film bags are positioned below the magazine shafts in step 101 so as to be able to receive the provided film bags. In step 102, the film bags in the magazine shafts are grasped by transfer arms. For example the grasping may be accomplished by a suction device that is enclosed by the transfer arms and that sucks the film bags at least partially in a two-dimensional manner. In step 103, the spools are moved downwardly. In step 104, the transfer arms are rotated around a common horizontal axis and, thereby, the film bags are positioned in an at least approximately vertical orientation.

After step 104 of rotating, in step 105, the transfer arms may be further moved downwardly and the film bags may be inserted, at least partially, into the film bag holders. After the step 105 of inserting, releasing of the transfer arms from the film bags may be performed in step 106.

In step 107 the transfer arms are moved upwardly. Subsequently in step 108, the spools are retracted. In step 109, the film bag holders with the film bags positioned therein may be removed from their positions below the magazine shafts.

While there have been shown and described fundamental novel features of the invention as applied to the preferred and exemplary embodiments thereof, it will be understood that omissions and substitutions and changes in the form and details of the disclosed invention may be made by those skilled in the art without departing from the spirit of the invention. Moreover, as is readily apparent, numerous modifications and changes may readily occur to those skilled in the art. Hence, it is not desired to limit the invention to the exact construction and operation shown and described and, accordingly, all suitable modification equivalents may be resorted to falling within the scope of the invention as claimed. It is the intention, therefore, to be limited only as indicated by the scope of the claims appended hereto.

The invention claimed is:

1. An apparatus for feeding film bags to a filling machine comprising:

a magazine having a plurality of parallel arranged magazine shafts for providing the film bags, film bag holders positionable below the magazine shafts for receiving film bags and transporting the received film bags to the filling machine, wherein a plurality of transfer arms are configured to grasp a film bag in one of the parallel arranged magazine shafts, wherein each of the plurality of transfer arms is assigned to one of the plurality of parallel arranged magazine shafts, wherein each of the plurality of transfer arms is further configured to transfer the grasped film bag to the film bag holder positioned below the magazine shaft, and wherein each film bag holder is associated with one of the magazine shafts, and wherein the transfer arms are configured to be rotatable around a common horizontal axis and to be vertically movable by means of a common support.

2. The apparatus of claim 1, wherein each of the transfer arms comprises at least one suction device for sucking the film bag.

3. The apparatus of claim 2, wherein each of the suction devices is configured to suck a partial area of a film bag.

4. The apparatus of claim 1, wherein a spool device comprises at least one spool and is positioned between two neighboring magazine shafts such that the at least one spool holds the film bags within the film bag holders in a position that suppresses shifting movement in an upward direction when releasing or subsequently moving transfer arms with respect to the film bags.

5. The apparatus of claim 4, wherein a transfer gap is allowed to be formed between the at least one spool and a base body of the magazine.

6. The apparatus of claim 4, wherein the at least one spool comprises a labyrinth guide that is formed as a protrusion and is configured to suppress upward movement of a film bag when the film bag is being guided to a bottom of the film bag holder.

7. The apparatus of claim 4, wherein the spool device further comprises a housing.

8. The apparatus of claim 1, further comprising at least one counter-holder configured to be horizontally movable for suppressing an upward movement of a film bag.

9. The apparatus of claim 1, wherein the film bag holders are configured as at least one of: bracket casings and lock casings.

10. The apparatus of claim 4, wherein the at least one spool is vertically movable.

11. The apparatus of claim 5, wherein the width of the transfer gap is less than 1 mm.

12. The apparatus of claim 4, wherein the at least one spool comprises a labyrinth guide that is formed as a protrusion and is configured to suppress upward movement of a film bag when the transfer arm detaches from the film bag.

13. A method for feeding film bags to a filling machine by means of an apparatus according to claim 1, comprising the steps:

providing film bags in magazine shafts of a magazine, positioning, below the magazine shafts, film bag holders for receiving and transporting the film bags, subsequently grasping the film bags in the magazine shafts by means of transfer arms and transferring the grasped film bags to the film bag holders by means of the transfer arms.

14. The method of claim 13, wherein the step of grasping comprises sucking the film bags by means of suction devices.

15. The method of claim 13, wherein the step of transferring further comprises the step: rotating the transfer arms around a common horizontal axis and thereby positioning the film bags in an at least approximately vertical orientation.

16. The method of claim 15, wherein after the step of grasping the film bags and prior to the step of rotating of the transfer arms, the spools are extended.

17. The method of claim 15, further comprising the steps after the step of rotating:

moving downwardly the transfer arms and at least partially inserting the film bags into the film bag holders and after said inserting, detaching the transfer arms from the film bags.

18. The method of claim 17, further comprising after the step of detaching: moving upwardly the transfer arms, and preferably rotating the transfer arms.

19. The method of claim 18, wherein the spools are retracted after moving the transfer arms upwardly.

20. The method of claim 19, further comprising moving the film bag holders away from their positions below the magazine shafts after retracting the spools.

* * * * *